United States Patent [19]

Swift

[11] Patent Number: 4,586,570

[45] Date of Patent: May 6, 1986

[54] COMBINATION SEAL AND LOCKING PIN

[75] Inventor: Allan W. Swift, Denville, N.J.

[73] Assignee: E. J. Brooks Company, Newark, N.J.

[21] Appl. No.: 426,291

[22] Filed: Sep. 29, 1982

[51] Int. Cl.[4] ..... A62C 23/10

[52] U.S. Cl. ..... 169/75; 24/16 PB; 292/307 R; 292/322

[58] Field of Search ..... 116/244; 169/75; 251/294, 306, 307; 137/384, 551; 24/16 PB; 248/74 PB, 74.3; 403/290, 326; 292/307 R, 322

[56] References Cited

U.S. PATENT DOCUMENTS

| | | | |
|---|---|---|---|
| 3,462,802 | 8/1982 | Merser | 292/322 |
| 3,466,077 | 9/1969 | Moberg | 292/322 |
| 3,467,427 | 9/1969 | Moberg | 292/322 |
| 3,600,027 | 8/1971 | Noland | 292/322 |
| 3,944,269 | 3/1976 | Lundberg | 292/307 R |
| 4,001,919 | 1/1977 | Moberg et al. | 292/322 |
| 4,088,194 | 5/1978 | Hard | 169/75 |

FOREIGN PATENT DOCUMENTS

| | | | |
|---|---|---|---|
| 1034386 | 3/1951 | France | 169/75 |

*Primary Examiner*—Joseph F. Peters, Jr.
*Assistant Examiner*—Michael J. Forman
*Attorney, Agent, or Firm*—Robert E. Ross

[57] ABSTRACT

A combination seal and locking pin for a fire extinguisher handle or other device in which two members must be retained in fixed relation to each other, in which the seal portion comprises a housing, a shackle to be received in the housing in locking relation and a pull ring for breaking the seal. The locking pin is detachably mounted onto the seal in a relationship such that pulling on the pull ring pulls the pin out of engagement with the handle and breaks the seal. The pull pin may be removed from the broken seal and assembled onto a new seal.

11 Claims, 5 Drawing Figures

COMBINATION SEAL AND LOCKING PIN

BACKGROUND OF THE INVENTION

Certain types of fire extinguishers, such as the $CO_2$ type are provided with an operating handle which is maintained in the closed position by a spring. Unintentional operation of the device is prevented by a locking pin which extends through aligned apertures in the handle and handle support. In some cases the pin is wired in place by a seal of the so-called "lead and wire" type. The wire, which is easily brokan, is retained around the handle by being imbedded in a lead pellet so that removal of the wire gives evidence of tampering or use. The assembly of the components of such a seal is time consuming and therefore expensive.

In U.S. Pat. No. 3,944,269 issued Mar. 16, 1976 and assigned to the same assignee as this application there is illustrated a seal for use with such fire extinguishers, which is formed of a single piece of molded plastic, and comprises an integral rigid plastic bar for extending through the handle and handle support apertures. Although the combination locking pin and seal of said patent has proved satisfactory in service, it does not meet the requirements established by certain organizations that establish industry standards for such devices, such as Underwriters Laboratories Inc., which require that the locking pin be made of metal.

SUMMARY OF THE INVENTION

This invention provides a combination seal and locking pin for a fire extinguisher of the type described above, in which the seal is provided with a socket and a shackle for being pulled through the socket into locking engagement to retain the seal in assembly, a pull ring extending from the socket to enable rapid release of the seal, and a separate metal pin retained on the seal, said pin being so mounted that when the pull ring is pulled, the pin is pulled out of the handle and handle support apertures as the seal is broken.

In a preferred embodiment of the invention the pin is provided with a loop at one end which is detachably retained around the socket by resilient means integral with the seal in a manner such that after the seal has been broken on removal from the extinguisher handle, the locking pin, which is often formed of stainless steel and therefore is the most expensive component of the assembly, can be readily removed from the broken seal for re-use.

DESCRIPTION OF THE ILLUSTRATED EMBODIMENT

Figure 1:
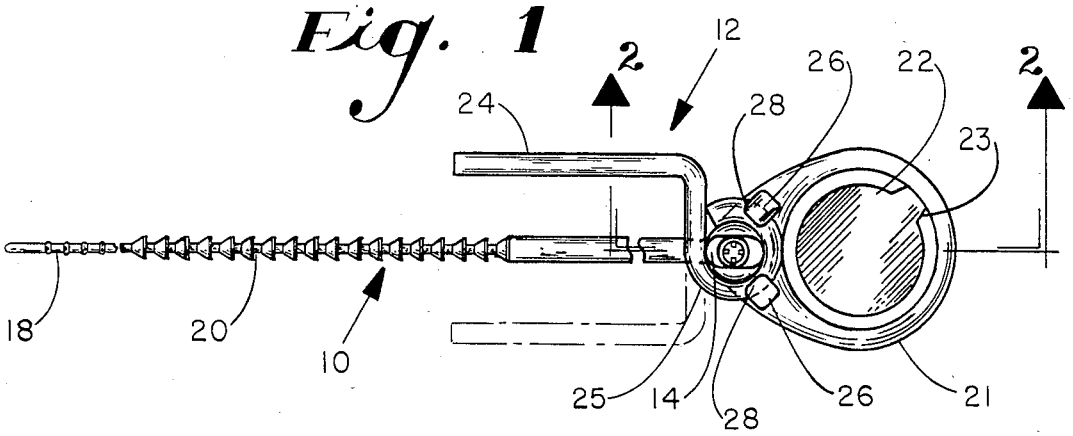
FIG. 1 is a top plan view of a combination seal and locking pin embodying the features of the invention.
Figure 2:
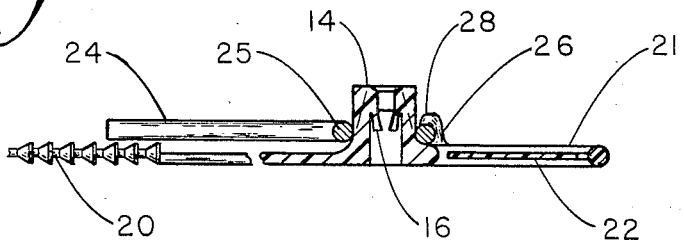
FIG. 2 is a view in section taken on line 22 of FIG. 1.
Figure 3:
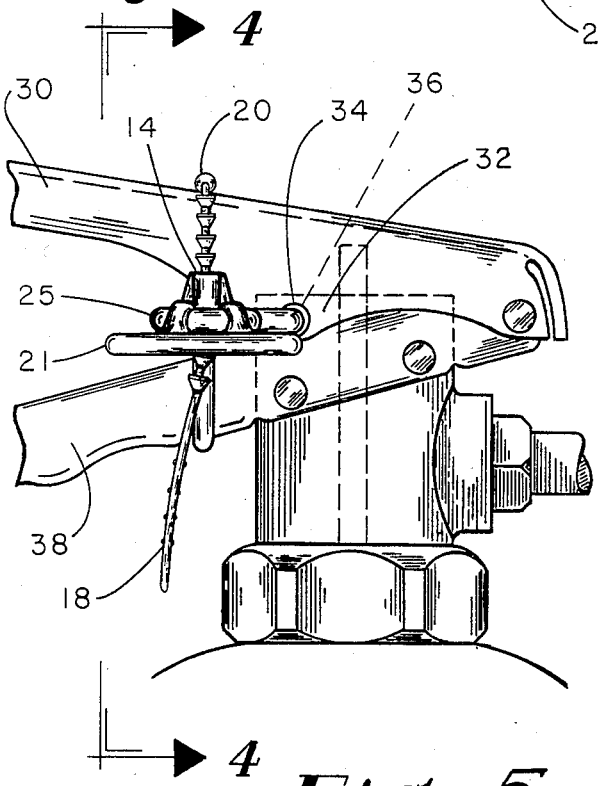
FIG. 3 is a view in side elevation of the seal and locking pin of FIG. 1 assembled onto the handle of a fire extinguisher.
Figure 4:
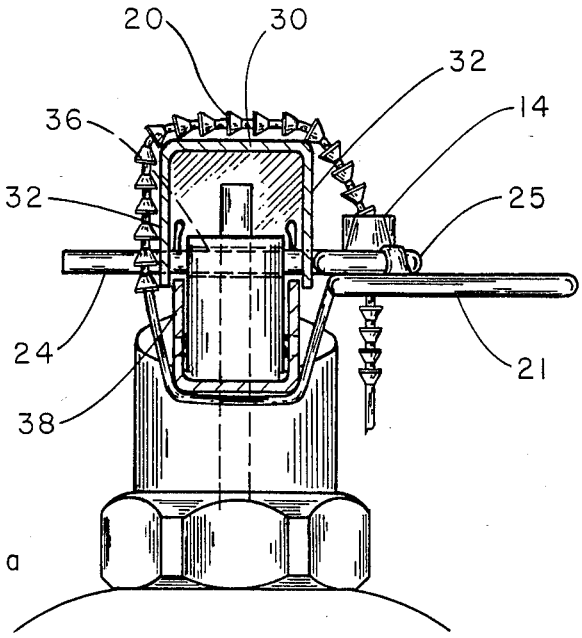
FIG. 4 is a view in section taken on line 44 of FIG. 3.

Referring to the drawing, there is illustrated a combination seal and locking pin for use with a fire extinguisher, said combination comprising a seal 10 formed of a single piece of molded plastic and a locking pin 12 formed of metal such as stainless steel detachably mounted on the seal.

The seal 10 comprises a hollow housing 14 having internal resilient fingers 16 to receive in locking engagement an elongated shackle 18 having a plurality of annular locking shoulders 20 formed thereon for cooperating with the fingers to lock the shackle against retraction through the housing after the shackle has been pulled through the housing and tightened.

Extending from the housing on the side opposite the shackle is a finger loop 21, which has a central tab 22 joined to the loop by a flexible member 23 for a purpose to appear hereinafter.

The housing 14 and the shackle 18 may have a configuration such as is shown in U.S. Pat. No. 3,467,427.

The locking pin 12 comprises a straight portion 24 and a retaining loop 25 at one end, said loop being disposed around the housing 14.

Projecting upwardly from the seal structure in suitable spaced relation to the housing are a pair of resilient posts 26 having pin retaining portions 28 at the upper ends which extend inwardly toward the housing to form a restricted entrance between the housing and the posts.

The locking pin 24 may be assembled with the seal by snapping the loop into position around the socket through said restricted entrance. The pin is thereafter detachably retained in assembly with the housing as illustrated in FIG. 1.

The seal and pin may then be assembled with a fire extinguisher handle 30 of the type having depending side portins 32 with apertures 34 normally aligned with an aperture 36 in a handle support 38, by inserting the pin 12 through the aligned apertures 34,36 and wrapping the shackle 18 around the handle support and handle, inserting the end of the shackle through the housing 14, and drawing it tight.

Thereafter the pin 12 may not be removed without breaking the shackle, thereby providing evidence of tampering or use. However, the pin may be readily removed from the fire extinguisher handle by pulling on the finger loop.

After use of the extinguisher, if the extinguisher medium is not completely exhausted, the pin 12 may be temporarily re-inserted into the handle apertures until the extinguisher can be re-charged and a new seal applied.

The tab 22 provides a readily visible place to apply identifying marks or numbers, yet is easily pushed out of the way by the insertion of a finger into the loop 21 to pull the locking pin.

Figure 5:
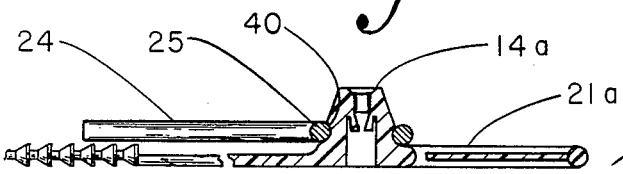
FIG. 5 is a section similar to FIG. 2, of another form of seal body for use in the combination of the invention.

Referring now to FIG. 5 of the drawing, there is illustrated a modified form of seal body, which comprises a housing **14*a*, a shackle 18*a*, and a finger loop 21*a*, and generally has the same structure as that of the seal 10, with the exception that the resilient posts 26 are omitted. To provide means for retaining the locking pin, the housing is provided with a circumferential groove 40 in the outer surface near the bottom of the housing. The groove 40 is shaped and dimensioned to receive the loop 25 of the locking pin in resilient engagement by passing the loop over the top of the housing and pressing it downwardly until the loop snaps into the groove 40**, where it is removably retained.

Although in the illustrated embodiments of the invention, the locking pin is retained in assembly with the seal by providing a loop on the pin and means for resilient engagement with the seal, other pin configurations and other means of releasably retaining the pin in assembly may be provided without departing from the scope of the invention.

Since certain other changes apparent to one skilled in the art may be made in the herein described embodiments of the invention without departing from the scope thereof, it is intended that all matter contained herein be interpreted in an illustrative and not a limiting sense.

I claim:

1. A combination seal and locking pin assembly for assembly with a device having a movable member and a stationary member with apertures which are aligned when the members are in a predetermined position, said seal comprising a body and an elongated shackle extending from the body, said body including socket means for receiving the remote end of the shackle in locking engagement, a finger loop extending from the body in a direction opposite to the shackle for engagement by a finger to break the assembled seal, said locking pin comprising an elongated end for assembly into the aligned apertures and an opposite end and the seal body having cooperating engaging means whereby when the finger loop is pulled the pin is pulled out of the aligned apertures and the shackle is ruptured, and in which said opposite end of the pin has a portion detachably retained on the seal body between the socket and the finger loop.

2. An assembly as set out in claim 1 in which said opposite end of the pin has a portion detachably retained around the socket means.

3. A combination seal and locking pin for assembly with a handle of a fire extinguisher or other device having two members movable in relation to each other with apertures which are aligned when the members are in a predetermined position, said seal comprising a body having an elongated shackle and an upstanding socket at one end of the shackle, said socket and shackle having means for locking engagement, said locking pin having a straight portion for entering said apertures and a loop portion at one end, said loop being positioned around the socket, and means associated with the socket for retachably retaining said loop in assembly on the socket.

4. A device as set out in claim 3 in which the means for detachably retaining the loop in assembly on the socket comprises an upstanding member disposed in spaced relation to the socket to resiliently retain the loop in position on the socket.

5. A device as set out in claim 3 in which the means for detachably retaining the loop in assembly on the socket comprises a groove formed in the exterior surface of the socket, said groove being shaped and dimensioned to receive the loop in resilient engagement.

6. A seal for use in combination with a locking pin for locking and sealing a fire extinguisher handle, said seal having a shackle, a body including a socket disposed at one end of the shackle, and means on the body for detachably engaging an end of a locking pin and releasably retaining it in assembly with the body.

7. A seal as set out in claim 6 in which the means for detachably retaining the locking pin is associated with the socket.

8. A seal for use in combination with a locking pin having a straight portion for locking a fire extinguisher handle and a loop at the other end, said seal comprising a body having a socket housing extending upwardly from the body and a shackle extending from the body for locking engagement in the housing, and means asociated with the housing for releasably retaining the loop of the pin around the housing.

9. A seal as set out in claim 8 in which said means for releasably retaining the loop of the pin around the housing comprises upwardly projecting retaining members disposed in suitable spaced relation to the housing to releasably retain the loop therebetween.

10. A seal as set out in claim 8 in which the means for releasably retaining the loop of the pin around the housing comprises a groove formed in the socket, said groove being shaped and dimensioned to receive the loop in resilient engagement.

11. A seal formed of a single piece of molded plastic and comprising a housing forming a socket, a shackle extending from the housing in one direction, said socket and said shackle having means for locking engagement, and a loop forming a finger aperture extending from the housing, and a thin disc substantially filling the finger aperture, said disc being adapted to receive identifying markings and being attached to the loop by a flexible connection so that it is readily flexed out of the opening when a finger is inserted therein.

* * * * *